US006196093B1

(12) United States Patent
Hu

(10) Patent No.: US 6,196,093 B1
(45) Date of Patent: Mar. 6, 2001

(54) HAND-HELD TOOL HANDLE

(76) Inventor: Cheng-Yin Hu, No. 137, Tu Tzu Tou, Tu Tou Tsun, Kuan Tien Shiang, Tainan Hsien (TW)

( * ) Notice: Subject to any disclaimer, the term of this patent is extended or adjusted under 35 U.S.C. 154(b) by 0 days.

(21) Appl. No.: 09/325,717

(22) Filed: Jun. 4, 1999

(51) Int. Cl.[7] ..... B25G 1/08
(52) U.S. Cl. ..... 81/490; 81/177.4; 16/111.1
(58) Field of Search ..... 81/490, 177.4; 16/111.1

(56) References Cited

U.S. PATENT DOCUMENTS 858,131 * 6/1907 Aichele ..... 81/490
5,499,562 * 3/1996 Feng ..... 81/177.4
5,517,885 * 5/1996 Feng ..... 81/177.4
5,522,291 * 6/1996 Liu ..... 81/490
5,782,150 * 7/1998 Huang ..... 81/177.4
5,802,936 * 9/1998 Liu ..... 81/450
6,032,332 * 3/2000 Lin ..... 116/111.1

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

A hand-held tool handle reflects to a handle with a hollow body, and the character is that the hollow body is in a longitudinal direction with an opening at one side of the handle. The inner hollow portion has a spring push button which has one end remained in the hollow body while the other end extending outwardly from the opening. The hollow body is mounted with a tool holder which has formed with a number of seats to receive bits thereat. The center portion of the tool holder has a strut corresponding to the push button, by pushing the push button, the tool holder will extend outwardly, and the bits may be picked for prompt usage.

3 Claims, 4 Drawing Sheets

HAND-HELD TOOL HANDLE

BACKGROUND OF THE INVENTION

1. Field of the Invention

This invention relates to a hand-held tool handle, and more particular to a handle with a side opening for mounting a tool holder for tool bits to be stored therein.

2. Prior Art

The conventional tools such as screw drivers or sockets are in two designs, one is a fixed bit installed on a handle, the other is a handle with a set of separate bits which are normally stored in a tool box, this causes inconvenience of carrying too many tools.

Therefore, a tool handle 5, as shown in FIG. 4 with a hollow body 51 to store a bit set 7 was devised which drills a hole from the bottom end of the handle 5 and inserts the bit set 7 into the hollow body 51. Then the opening is covered by a lid 8 by means of threads 81 into the opening of the handle 5. This requires users to take all of the bit set 7 out from the hollow body 51 separately in order to replace an appropriate bit, and then insert the bit set 7 back into the hollow body 51 before the lid 8 covers the opening. This consumes much valuable time.

SUMMARY OF THE INVENTION

It is therefore a main object of the present invention to provide a hand-held tool handle which is easy to use and needs not to take all bits out separately when replacing bits.

This object is achieved by a hand-held tool handle consisting of a handle with a hollow body, and the character is that the hollow body is in a longitudinal direction with an opening at one side of the handle. The inner hollow portion has a spring push button which has one end remained in the hollow body while the other end extending outwardly from the opening. The hollow body is mounted with a tool holder which has formed with a number of seats to receive bits thereat. The center portion of the tool holder has a strut corresponding to the push button, by pushing the push button, the tool holder will extend outwardly, and the bits may be picked for prompt usage.

Figure 1:
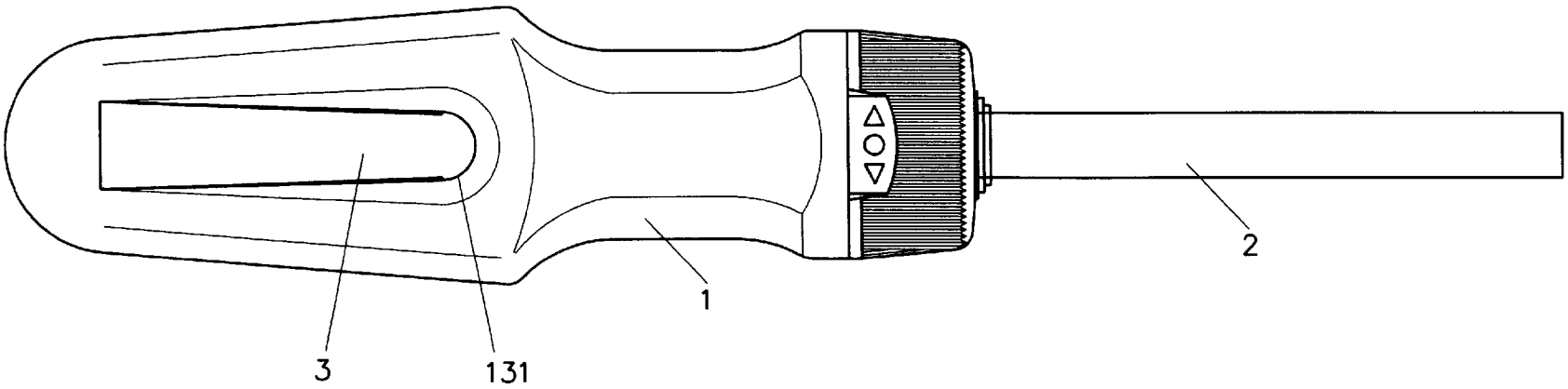
FIG. 1 is a top view of the present invention.

DETAILED DESCRIPTION OF THE PREFERRED EMBODIMENT:

The present invention, as shown in FIG. 1, comprises a handle 1 with a rod 2 extending forward. The handle 1 has a longitudinal hollow body 11 with a side opening 111. The handle 1 may be performed by a hard plastic material and wrapped with a flexible layer 13. The flexible layer 13 has an opening 131 which has a smaller inner diameter with respect to the opening 111 of the hollow body 11, and which is corresponding to and wrapping the edge of the opening 111 tightly. The hollow body 11 has a push button 12 having a spring 121. One end of the push button 12 seats within the hollow body 11 while the other end extends outwardly from the handle 1 and is confined from moving outwardly away from the handle 1 by the spring 121. The hollow body 11 has mounted with a tool holder 3 which has a number of seats 31 to receive a bit set 4. A strut 32 extends from the center portion of the tool holder 3 corresponding to the push button 12, in such, the tool holder 3 securely can be mounted in the hollow body 11.

Figure 2:
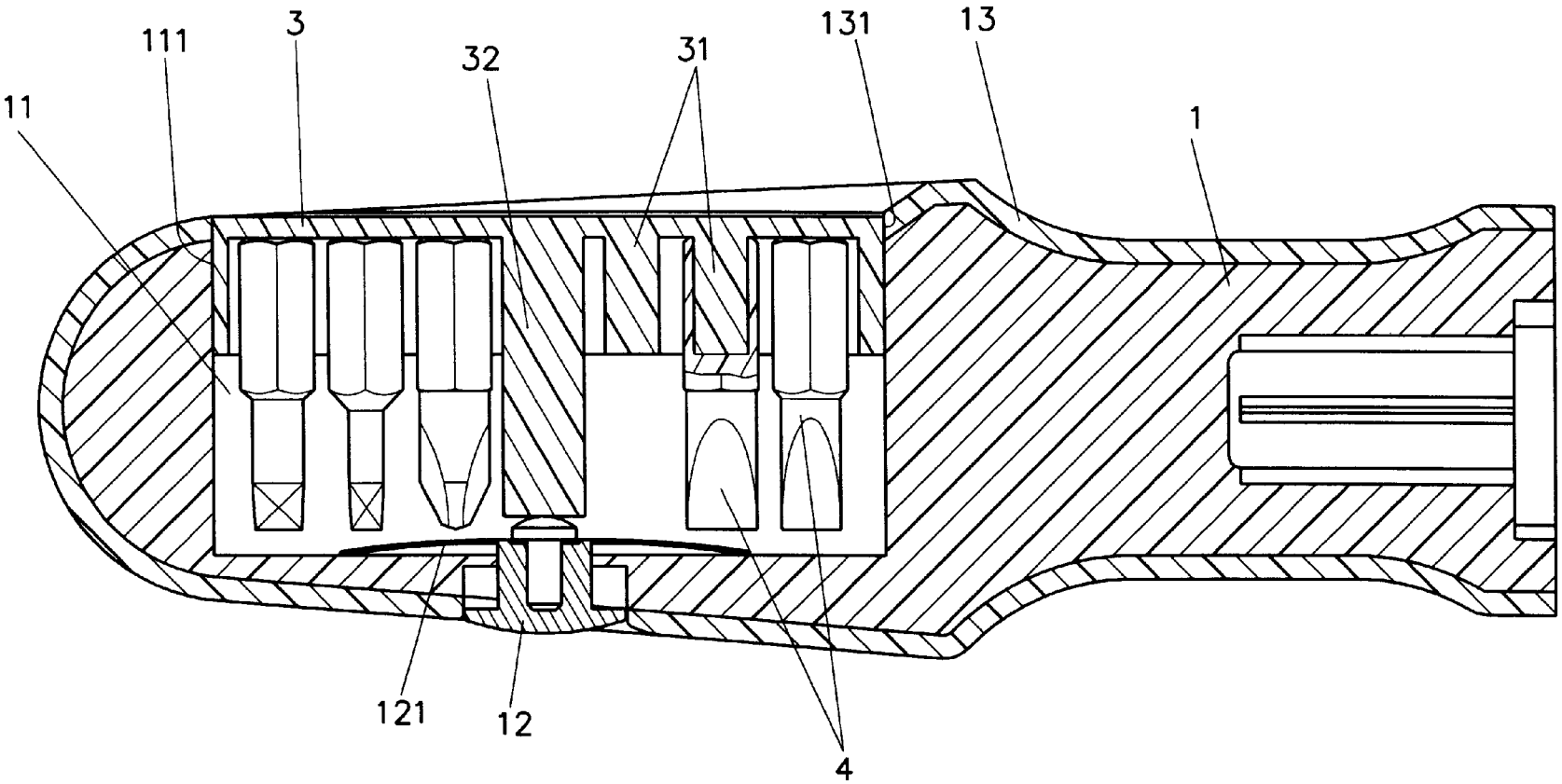
FIG. 2 is a side view of the handle of FIG. 1, partially sectioned, with a bit set mounted in the hollow body of the handle.

To operate, insert the bit set 4 to the seats 31 of the tool holder 3, as shown in FIG. 2, and place the tool holder 3 into the hollow body 11, whereas the opening 131 of the flexible layer 13 will cause a friction by touching the tool holder 3, thus, the tool holder 3 is secured therein. The force from the strut 32 urging the push button 12 creates a counter force which secures the tool holder 3 in the hollow body 11.

Figure 3:
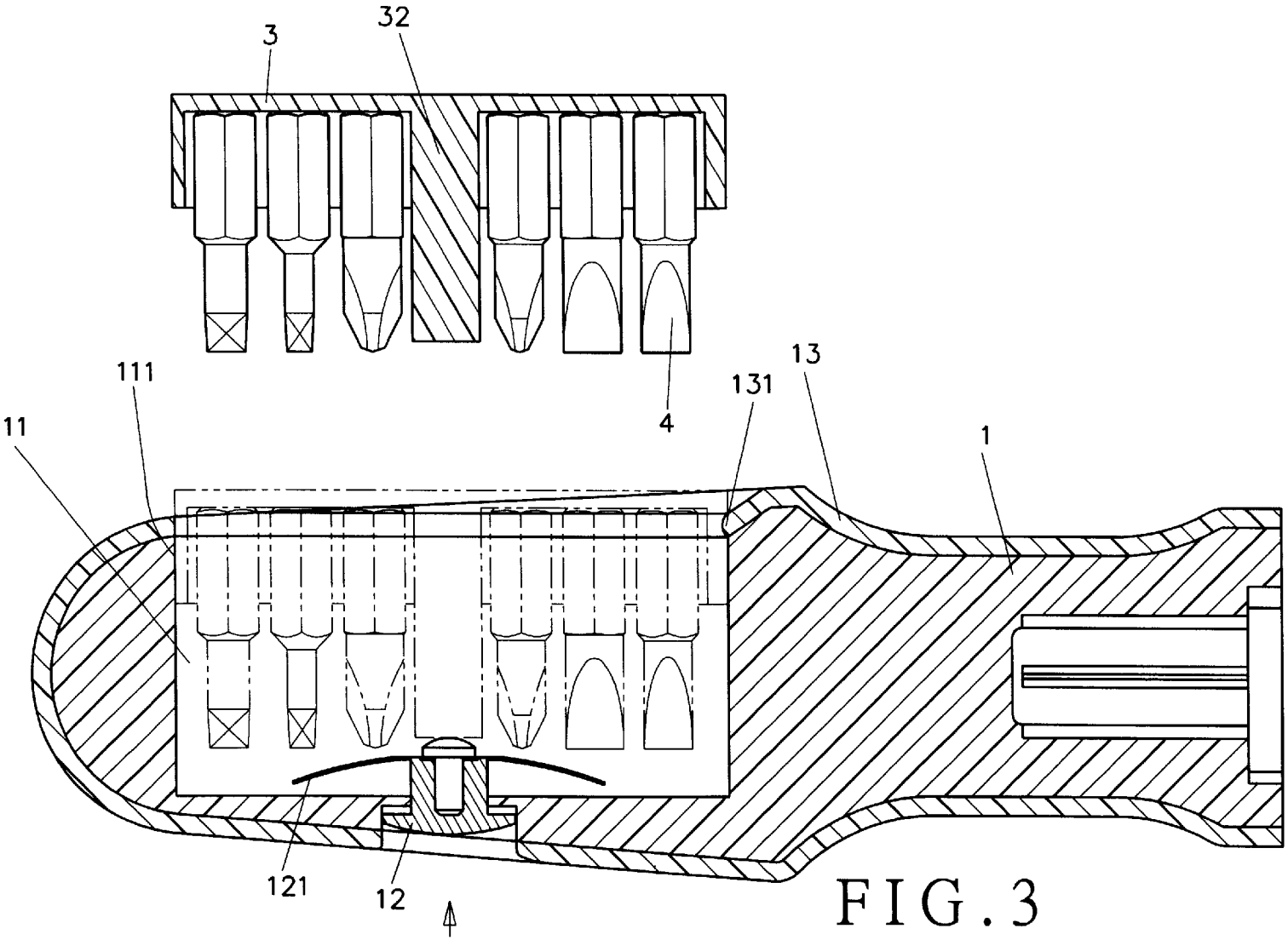
FIG. 3 is a view similar to FIG. 2, but the bit set has been taken out of the hollow body of the handle.
Figure 4:
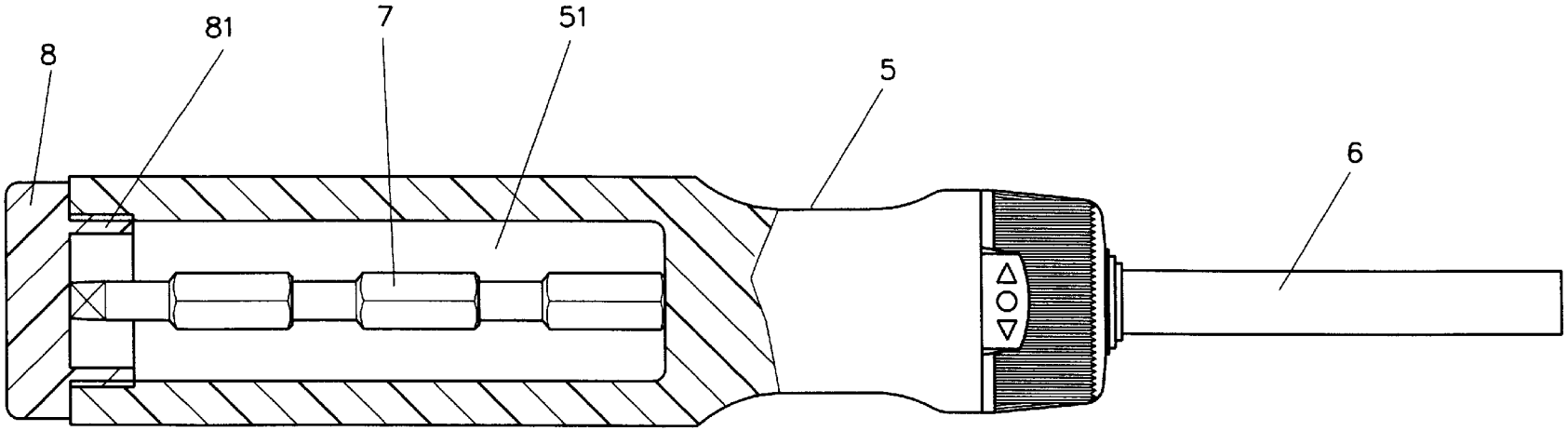
FIG. 4 (PRIOR ART)
FIG. 4 is a side sectional view of a prior art.

To replace a bit, as shown in FIG. 3, push the push button 12 which urges the strut 32 backward, thus the tool holder 3 detaches from the hollow body 11, and an appropriate bit may easily be chosen.

While this has been described and illustrated one specific embodiment of the invention, it will be clear that variations in the details of the embodiment specifically illustrated and described may be made without departing from the true spirit and scope of the invention as defined in the appended claims.

I claim:

1. A handheld tool having a plurality of detachable bits comprising:

(a) a longitudinally extended handle having opposed first and second side portions, said handle having formed therein a hollow body compartment, said first side portion having formed therethrough an opening communicating with said hollow body compartment, said handle including a flexible wrapping layer protrusively lining at least a partial periphery of said opening;

(b) a holder for receiving the detachable bits engaging said first side portion opening of said handle, said holder having a strut extending transversely therefrom into said hollow body compartment; and, (c) a push button assembly displaceably coupled to said second side portion of said handle, said push button assembly extending into said hollow body compartment and being disposed in at least partial alignment with said strut of said holder for imparting an outward displacement force thereto responsive to user actuation, whereby said holder is disengaged from said first side portion opening of said handle.

2. A handheld tool as recited in claim 1 wherein holder has formed therein a plurality of seats for retentively receiving respective ones of the detachable bits.

3. A handheld tool having a plurality of detachable bits comprising:

(a) a longitudinally extended handle having diametrically opposed first and second side portions, said handle having formed therein a hollow body compartment and an opening in communication therewith formed in said first side portion;

(b) a holder for receiving the detachable bits releasably engaging said first side portion opening of said handle, said holder having a strut extending transversely therefrom into said hollow body compartment; and, (c) a push button assembly displaceably coupled to said second side portion of said handle for imparting an outward displacement force to said holder strut responsive to user actuation thereof, said push button assembly including:

(1) a first member passing through said second side portion of said handle;

(2) a second member coupled to said first member, said second member extending into said hollow body compartment of said handle to abut said strut of said holder; and, (3) a deflection spring captured between said first and second members for resiliently biasing said first member outward from said hollow body compartment of said handle;

whereby said holder is disengaged from said first side portion opening of said handle responsive to depression of said first member by a user.

* * * * *